United States Patent [19]

Ottemann

[11] 4,225,118

[45] Sep. 30, 1980

[54] DIRECT DRIVE DECK WINCH

[75] Inventor: William C. Ottemann, San Carlos, Calif.

[73] Assignee: Barient Company, San Carlos, Calif.

[21] Appl. No.: 962,246

[22] Filed: Nov. 20, 1978

[51] Int. Cl.[3] ..... B66D 1/30

[52] U.S. Cl. ..... 254/333; 254/376

[58] Field of Search ..... 254/150 R, 175.5, 175.7, 254/186, 186 HC

[56] References Cited

U.S. PATENT DOCUMENTS

| | | | |
|---|---|---|---|
| 3,145,974 | 8/1964 | Short | 254/150 R |
| 3,985,340 | 10/1976 | Guangorena | 254/150 R |
| 4,143,855 | 3/1979 | Burton et al. | 254/150 R |
| 4,151,980 | 5/1979 | Burton et al. | 254/150 R |

*Primary Examiner*—Leonard D. Christian

*Attorney, Agent, or Firm*—Owen, Wickersham & Erickson

[57] ABSTRACT

A deck winch for sailing craft provides a direct drive from main shaft to drum and has a self-tailing capability. Pawls mounted in the drum near its upper end extend through an arcuate opening in a stationary extended base member to engage the shaft intermittently. The base member affords a fixed mount at its upper end for the line lifter of a self-tailing device and comprises a cylindrical sleeve whose axis is offset from the axis of the main winch shaft. As a crank turns the shaft, each pawl progressively projects through the base member opening to drivingly engage the shaft for a portion of a revolution and then is cammed outwardly out of engagement as the next pawl takes over. The invention provides a relatively simple winch having both direct drive and self-tailing capabilities.

11 Claims, 6 Drawing Figures

DIRECT DRIVE DECK WINCH

This invention relates to a drum winch for providing tension on a rope or line and more particularly it relates to such a winch that combines a direct drive capability with self-tailing and is particularly adaptable for use on sailing craft.

BACKGROUND OF THE INVENTION

On deck winches for sailing craft it is often desirable to provide what is commonly referred to as a self-tailing device, generally mounted on the upper end of the winch above its drum. Such a device provides a means for gripping and maintaining tension on the line around the winch drum so that wind-up and tailing of the line by the winch can be accomplished without slippage. An essential part of the self-tailing device is a so-called line-lifter element that directs the line from the winch drum to the self-tailer's gripping element.

This line-lifter element must remain stationary with respect to the drum in order to accomplish its essential function. Prior to the present invention, this requirement created a problem, namely that of providing a stationary portion of the winch structure at the upper end of the winch drum.

In previous winch designs the line-lifter element was secured to the upper end of a stationary base member. This was more easily done when the winch utilized complicated internal gearing to drive the drum. Heretofore, there was no way to provide a direct driving interconnection between the winch shaft and drum while also providing self-tailing.

A general object of the present invention is to provide a winch that solves the aforesaid problem and more specifically a winch having a self-tailing means and yet capable of providing a direct drive from the main shaft to the drum without complicated internal gearing.

Another object of the present invention is to provide a winch that provides a direct drive between main shaft and its drum and a self-tailing means with a fixed line-lifter that is held stationary by an extended base member of the winch.

Another object of the present invention is to provide a winch that provides both self-tailing and a direct drive made between main shaft and drum and which is particularly well-adapted for ease and economy of manufacture.

Still another object of the present invention is to provide a winch wherein a self-tailing device is attached to an extended fixed base member that supports an axially offset shaft which is engaged intermittently by driving pawls in the drum which extend through an opening in the base member.

BRIEF SUMMARY OF THE INVENTION

The aforesaid objects are accomplished by a winch having a stationary base member with a lower portion used primarily to secure the winch to its supporting surface such as the deck of a sailing boat. An upper portion of the base member supports a short main shaft which is turned by a removable crank. The shaft extends downwardly through the elements of a self-tailing device comprised primarily of a clamp ring, a coiled spring and a line-lifter. The spring is arranged to urge the clamp towards the end of the drum so as to grip the end of a line from the drum. The line-lifter has a hub portion which is threaded to the upper end of the base member and has an outwardly projecting arm with an end portion for deflecting the line from the drum to the space formed between the clamp ring and the end of the drum.

The winch shaft is supported within an offset base in the upper end of the base member. An arcuate side opening is provided within the base member and a series of spring loaded pawls are mounted on the inside of the drum at the same level as the opening. Thus, a driving engagement between the shaft and the drum is afforded by the pawls which successively project through the opening into driving position and then retract as the shaft is turned. The arrangement thus provides a winch with direct drive capability while also being self-tailing, without the use of expensive internal gearing.

Other objects, advantages, and features of the invention will become apparent from the following detailed description of one embodiment presented in conjunction with the accompanying drawing.

DETAILED DESCRIPTION OF PREFERRED EMBODIMENT

Figure 1:
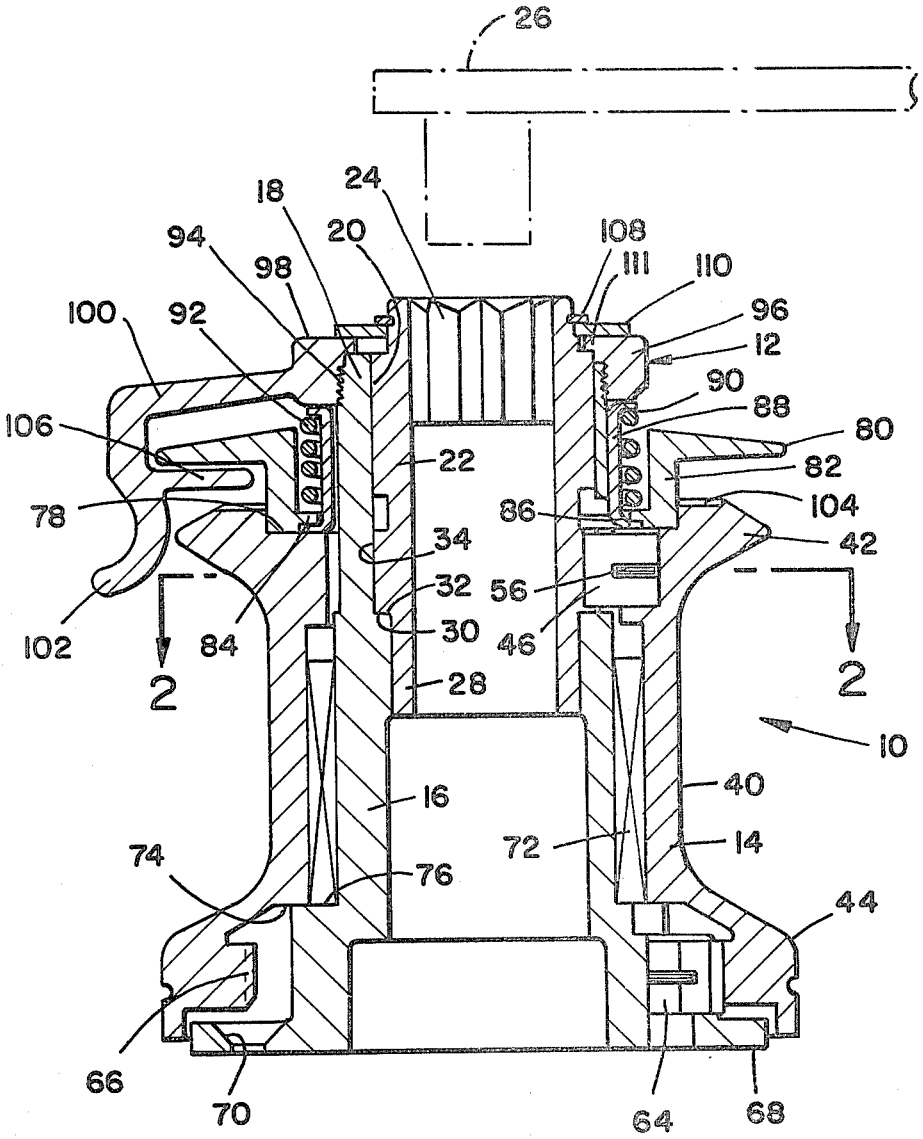
FIG. 1 is a view in side elevation and in section showing a winch according to the present invention.

With reference to the drawing, FIG. 1 shows a winch 10 embodying the features of the present invention and adapted to be secured to the deck of a sailboat. In the embodiment shown the winch has a simple, single-speed direct drive mode of operation, and yet is also equipped with a self-tailing device 12 of the type disclosed in U.S. Pat. No. 3,985,340 which has the same assignee as the present invention. Thus, a relatively low cost, but versatile winch is provided which is particularly adaptable for use on small sailing craft.

In addition to the self-tailing device, the winch 10 comprises a rotatable drum 14, a fixed base member 16 with an upper portion 18 having an offset bore 20 that supports a main shaft 22.

The shaft is generally tubular and has an upper end with a series of intersecting flat surfaces on its inner wall forming a socket 24 for a removable crank 26 (shown in phantom).

Figure 2:
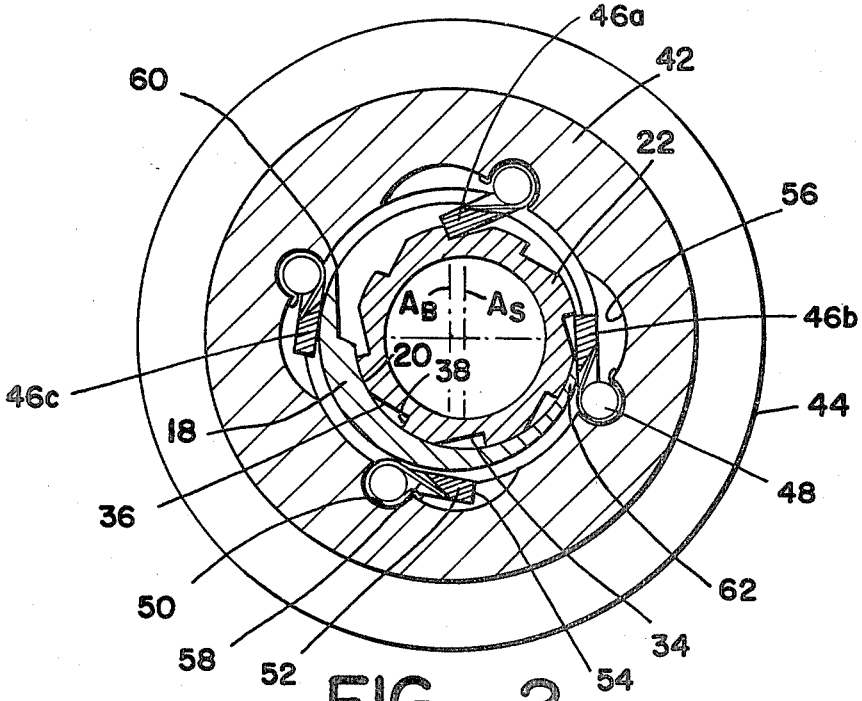
FIG. 2 is a view in section taken along line 2—2 of FIG. 1.
Figure 3:
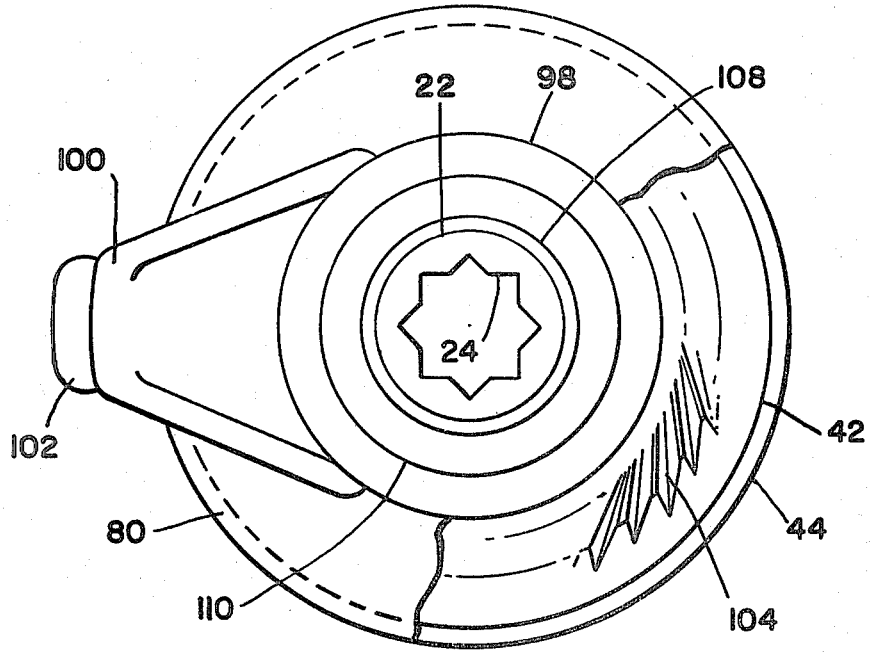
FIG. 3 is a top view of the winch of FIG. 1.

The outer surface of the shaft extending downwardly from its upper end is cylindrical and is dimensioned to form a normal rotating fit within the base 20 of the base member 16. A lower end portion 28 of the shaft has a smaller diameter formed by a shoulder 30 that engages a complementary shoulder 32 on the base member for retaining the shaft axially in position. Just above its lower end portion, the shaft is provided with a series of circumferentially spaced apart and axially extending notches 34. As shown in FIG. 2, each notch has an inwardly directed ramp surface 36 which terminates at an end surfaces 38 that is in a plane essentially perpendicular to the ramp surface and also passes through the central axis of the shaft.

The winch drum 14 has a cylindrical center portion 40 around which a line is wrapped during normal use, with a flared out upper end portion 42, and a similarly flared out lower end 44. As shown in FIG. 2, a series of four pawls 46 are supported at spaced apart locations within the inner wall of the upper drum portion 42. Each pawl is constructed in the conventional manner with a cylindrically shaped inner end portion 48 that fits within a similarly shaped socket 50 and a flat finger portion 52 with one side surface projecting tangentially from the inner end portion and having a flat end surface 54 perpendicular to the side surface. Adjacent each socket is another recess 56 within which the pawl may be retracted when it is not engaging the shaft. A wire spring 58 extends around each pawl and is seated in its socket with an extended end portion that constantly urges the flat finger portion of each pawl inwardly and away from the recess 56 and inner wall of the winch drum.

As previously stated, the central axis $A_s$ of the shaft 22 and thus the bore 20 within the upper portion 18 of the base member 16 is offset or spaced from the central axis of the base member. These two axes are represented by dotted lines in FIG. 2. The amount of this offset distance may vary for winches of different size, but for small winches having a drum diameter of around 3 to 4 inches, the shaft offset distance may be around 0.08 to 0.10 inches.

Figure 5:
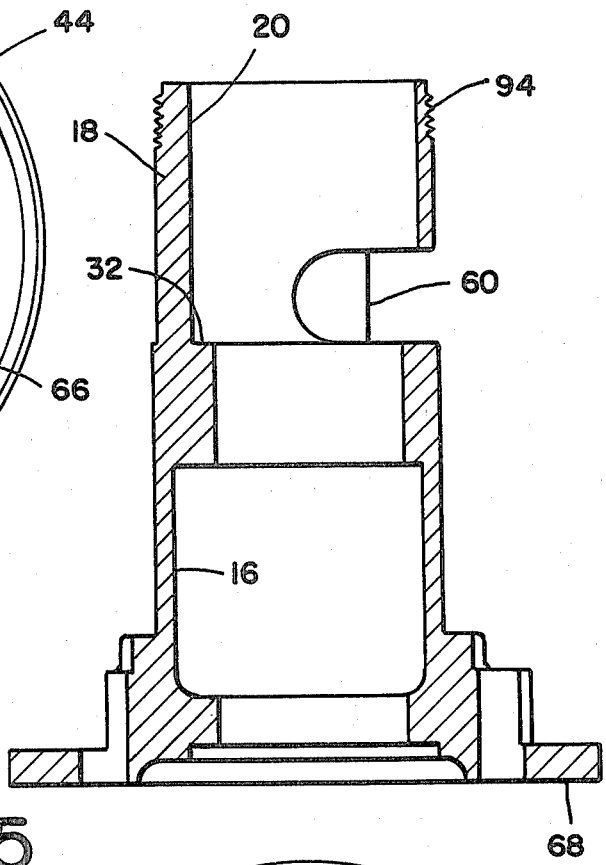
FIG. 5 is a view in elevation and in section showing the base member for the winch for FIG. 1.
Figure 6:
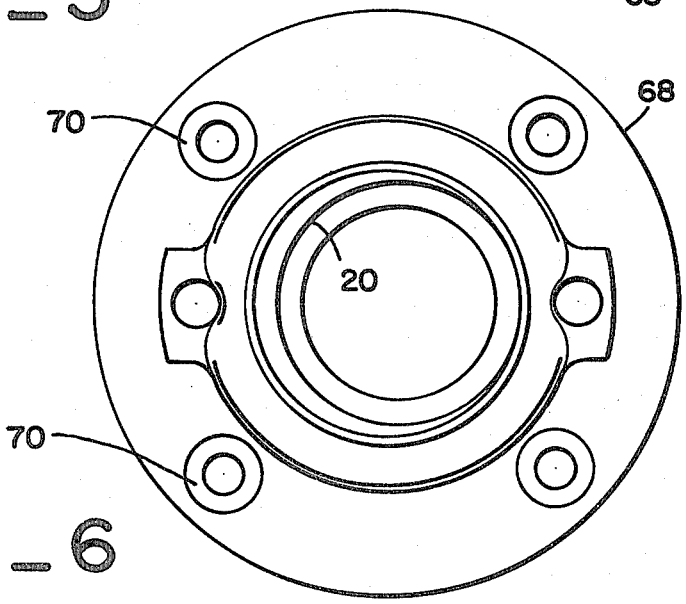
FIG. 6 is a top view of the base member shown in FIG. 5.

As best shown in FIG. 5, an arcuate or opening 60 is provided that extends almost around one side of the upper portion of the base member and has a width in the axial direction that is somewhat greater than the end width of the pawl 46.

Thus, as shown in FIG. 2, the pawls are aligned with and can extend through the opening 60 of the base member to engage the shaft notches 34 as the shaft is turned.

Actually, only one pawl is in full driving engagement with the shaft at any given time. With reference to FIG. 2, it can be seen that as the shaft is turned in the clockwise direction, one pawl **46*a* is in full driving engagement with the shaft while the previously driving pawl 46*b* is being cammed out of engagement with the shaft by a tapered edge portion 62 of the base member opening 60. The next pawl 46*c* to assume its driving position is still retracted by the outside surface of the stationary base member. Thus, as the shaft is turned by its operating crank, each pawl moves successively to the opening 60 of the base member, drops into a notch 34 of the shaft 22** to provide a period of driving engagement therewith, and is then cammed out of engagement as the pawl reaches the end edge of the opening. The fact that the shaft is offset from the axis of the base member, as previously described, enables the pawls to be moved into and out of engagement with the shaft notches without binding.

Figure 4:
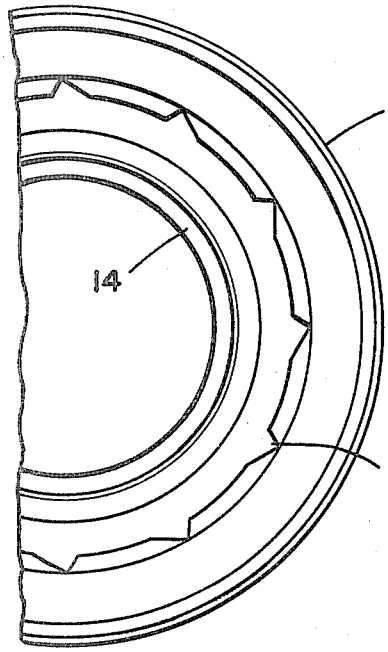
FIG. 4 is a bottom view of the winch of FIG. 1.

As the drum 14 is turned by the shaft, as described above, it is prevented from turning backward by a series of pawls 64 mounted in the bottom portion of the base member. These are spring loaded pawls similar to the driving pawls 46 and they are urged outwardly from the base member to ratchet against a series of circumferentially spaced apart notches 66 on the inside of the lower drum portion 44. (See FIG. 4) Thus, when no driving force is being exerted, the tension load of any rope or line on the drum is taken up by the lower ratchet pawls 64.

The assembly or dis-assembly of the winch 10 is simple and can be accomplished easily with a minimum of simple tools. The base member has a flange 68 on its lower end forming a bottom plane surface and having a series of holes 70 for suitable bolts to secure the winch to a boat deck. The drum 14 fits over the upper portion of the base member, separated from it by a toroidal roller bearing 72. An internal shoulder 74 formed at the lower end of the center drum portion 40 engages a shoulder 76 forming the transition between the lower and upper portions of the base member 16. Seated within an annular recess 78 on the upper end of the winch drum is the self-tailing device 12. The latter comprises an annular clamp ring 80 having a short cylindrical portion 82 that fits just inside the recess 78 with an outer flange that extends radially outwardly from its upper end and a much smaller flange 84 that extends inwardly from from near its lower end. This lower, inner flange extends over an outwardly projecting end lip 86 on the lower end of an annular retainer 88. This retainer has a sliding fit around the upper end of the base member 16 and an upper outwardly extending lip 90 similar to the lower lip. A coiled spring 92 is retained between the upper lip and urges the inner flange of the clamp ring downwardly toward the lower spring retainer lip. The top end portion 18 of the base member is provided with external threads 94 which are utilized for securing the hub portion 96 of a line lifter 98 comprising an essential element of the self-tailing device 12. A line lifter arm 100 projects radially outwardly from its hub portion and then downwardly to form a hook-like end portion 102. The latter is spaced slightly outwardly from and near the upper end of the drum. Since it is attached to the base member, the line lifter remains stationary. When the self-tailer is used, the end of a line wrapped around the drum passes around the hook-like end of the line lifter and is deflected upwardly so that it can be placed between the clamp ring 80 and the top annular surface 104 of the drum which is preferably serrated to help provide a good grip on the line. The clamp ring, forced downwardly by the spring 92, grips the line or rope between clamp ring and drum to maintain line tension on the wrapped line portion on the drum. As the winch is operated, the aforesaid line tension is maintained as the line is progressively removed by an ejection finger 106 on the line-lifter arm, and the winch is therefore self-tailing.

To complete the assembly, the shaft 22 which extends slightly above the line lifter hub 96 is retained in place by a flange 111 on the line-lifter engaging the top of the shaft 22. A washer 110 is held in place by a conventional snap ring 108 which fits in an outer groove on the shaft.

From the foregoing it should be apparent that the present invention provides a relatively simple but versatile deck winch which affords a direct drive capability as well as self-tailing without the need for complicated internal gearing. The use of the opening in the upper portion of the base member and the offset shaft enables one pawl 46 at a time to come into driving engagement between notches 34 of the shaft 22 and the drum 14. Thus, the shaft can be relatively short and need not extend downwardly to drive pinion gears and a ring gear in the heretofore conventional manner. Of course, if additional gearing were desired to provide two speeds on the winch instead of a single speed, this could be accomplished while maintaining the advantages of the present invention.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A direct drive winch for a rope, including in combination:

a stationary base member having a lower portion adapted to be attached to a flat surface and an upper portion whose longitudinal axis is parallel to the axis of said base member and an arcuate opening in said upper portion;

a rotary input shaft rotatably supported within said base member and having a series of circumferentially spaced-apart notches on its outer surface located at the same level as said arcuate opening;

a rotary drum rotatably supported by said base member;

bearing means between said rotary drum and said base member;

a series of movable driving pawls supported within said drum and extendable through said opening in said base member as said drum rotates around it;

and self tailing means fixed to the upper portion of said base member;

whereby at least one said driving pawl is in contact with one notch of said shaft in the driving direction, each said pawl moving said drum for a portion of one revolution before it is disengaged from the notch and moved out of said opening.

2. The winch as described in claim 1 wherein the axis of said shaft is spaced from the central axis of said base member toward said opening.

3. The winch as described in claim 1 wherein said opening in said base member extends for an arcuate distance of less than 180° on the side of the upper portion of said base member that is closest to the axis of said shaft.

4. The winch as described in claim 1 wherein at one end of said arcuate opening said outer surface of said base member is leveled inwardly to form a cam surface for extracting an engaged pawl from a notch of said shaft.

5. The winch as described in claim 1 including a generally cylindrical socket in the upper portion of said drum for supporting each said driving pawl, and a relatively shallow recess adjacent each said socket for accommodating a pawl when it is disengaged from said shaft and is moving around the outer surface of said base member.

6. The winch as described in claim 1 wherein four pawls are provided in the upper end portion of said drum.

7. The winch as described in claim 1 including a threaded portion on the upper end of said base member for retaining said self-tailing means.

8. The winch as described in claim 1 wherein said self-tailing means comprises an annular clamp ring; spring means for urging said clamp ring axially toward the end of said drum; and line lifter means threaded to the upper portion of said base member above said spring means.

9. The winch as described in claim 8 wherein said line lifter means has a radial arm portion that extends outwardly and downwardly with a curved end portion for deflecting a rope from said drum to a space between said clamp ring and the upper end of said drum.

10. The winch as described in claim 8 wherein said clamp ring has a cylindrical sleeve portion with an outwardly extending flange at its upper end and an inwardly extending inner flange near its lower end; and a sleeve-like retainer extending around said base member adjacent said spring means and having a lip portion around its lower edge which is engaged by said inner flange.

11. The winch as described in claim 1 including ratcheting means for preventing reversal of said drum from its driving direction comprising ratchet pawls in said lower portion of said base member adapted to engage with circumferentially spaced-apart notches on the inside of a lower drum section.

* * * * *